US006196293B1

(12) United States Patent
Lee

(10) Patent No.: US 6,196,293 B1
(45) **Date of Patent: *Mar. 6, 2001**

(54) LOUVERED BLIND CONTROLLER SYSTEM

(76) Inventor: Paul Lee, 12839 Sky Knoll, Houston, TX (US) 77082

( * ) Notice: Subject to any disclaimer, the term of this patent is extended or adjusted under 35 U.S.C. 154(b) by 0 days.

This patent is subject to a terminal disclaimer.

(21) Appl. No.: 09/519,212

(22) Filed: Mar. 6, 2000

Related U.S. Application Data

(63) Continuation of application No. 08/631,139, filed on Apr. 15, 1996, now abandoned, which is a continuation-in-part of application No. 08/458,398, filed on Jun. 2, 1995, now abandoned.

(51) Int. Cl.[7] ..... E06B 9/30

(52) U.S. Cl. ..... 160/168.1; 160/178.1 R

(58) Field of Search ..... 160/168.1 V, 168.1 R, 160/173 V, 173 R, 176 V, 176 R, 177 V, 177 R, 178.1 R, 178.1 V, 178.2 R

(56) References Cited

U.S. PATENT DOCUMENTS 2,410,549 * 11/1946 Olson ..... 160/178.2 R X
5,465,775 * 11/1995 Biba et al. ..... 160/168.1 R
5,465,779 * 11/1995 Rozon ..... 160/168.1 V
5,472,035 * 12/1995 Biba et al. ..... 160/178.1 R X
5,472,036 * 12/1995 Judkins ..... 160/178.2 R
5,501,262 * 3/1996 Inaba et al. ..... 160/173 R X
5,513,687 * 5/1996 Tuzmen et al. ..... 160/168.1 R
5,553,649 * 9/1996 Chisaka et al. ..... 160/168.1 R
5,553,653 * 9/1996 Rozon ..... 160/178.1 R X
5,850,863 * 12/1998 Huang ..... 160/168.1 R

* cited by examiner

*Primary Examiner*—Bruce A. Lev
(74) *Attorney, Agent, or Firm*—Alan J. Atkinson

(57) ABSTRACT

An improved controller for opening and closing a vertical blind over a door or window opening. A rotatable mechanism pivots individual louvers or vanes in the window blind. A cord has first and second lengths ending in a looped end retained by a bar. A handle is engaged with a cord lock for selectively grasping the cord for moving the vanes horizontally across the opening. The rotatable mechanism can comprise a hollow cylinder to permit reciprocation of the rotatable mechanism relative to the handle. The cord is substantially enclosed within the handle and the rotatable mechanism so that the looped end of the cord is not accessible to persons adjacent the window blind.

13 Claims, 4 Drawing Sheets

LOUVERED BLIND CONTROLLER SYSTEM

This Application is a continuation application of patent application U.S. Ser. No. 08/631,139 filed Apr. 15, 1996, now abandoned, entitled "Louvered Blind Controller System" which was a continuation-in-part patent application of U.S. Ser. No. 08/458,398 filed Jun. 2, 1995now abandoned, entitled "Louvered Blind Controller".

BACKGROUND OF THE INVENTION

The present invention relates to a controller for operating a louvered blind. More particularly, the present invention relates to a louvered blind controller system that encloses an operating cord or chain within a control handle and facilitates the operation of vertical blinds relative to an opening.

Vertical blinds shield window and door openings to block the passage of light and to provide privacy. Louvered blinds are constructed from a plurality of louvers or vanes that can be individually rotated about an axis to open and to close the blind. Typically, the rotation of such vanes is controlled by rotation of a wand attached to a gear mechanism or by pulling on a chain engaged with a gear mechanism.

In a blind where the vanes hang vertically, the blind can be opened and closed by moving the vanes to one side of the opening. This operation is controlled by pulling a cord attached to a mechanism, or by physically pulling the vanes along a track attached to the head rail of the window blind. In a window blind where the vanes are horizontally oriented, the window blind can be raised and lowered by pulling a cord attached to a mechanism that engages the cord to lock the location of the vanes at a desired elevation.

Conventional blinds incorporate a looped cord having two cord lengths. The cord lengths are attached to a mechanism inside the blind that moves the vanes, and either cord length can be pulled to selectively open or close the blind vanes. In other blind designs, either cord length can be pulled to selectively open or close the blind across the opening.

Such looped cords hang free from one side of the blind, and the necessary length of the looped cord depends on the width of the opening. Blinds for large openings require a looped cord extending to the floor, which creates a potential safety hazard for small children. Because of this hazard, efforts have been made to eliminate looped cords from blinds.

In one design of a blind having vertical vanes, a wand controls the rotation of the vanes, and the vanes are manually pulled across the opening to close the blind. Although such blind does not incorporate a looped cord, the blind requires a person to walk along the length of the opening to open or close the blind. This procedure can be difficult when furniture or other obstructions block the window or door opening.

Another concept in window blinds eliminates the looped cord by incorporating an electric powered drive mechanism which selectively operates the blind and the individual vanes. The electric mechanism substantially increases the cost of the window blind and increases the number of mechanical components subject to failure.

One window blind concept is shown in U.S. Pat. No. 5,472,035 to Biba et al. (1995), wherein an elongated wand incorporated a lengthwise passage having an open slot along one side of the wand to permit vertical movement of components relative to the wand. However, the slot substantially weakens the wand and requires additional material for strength. In another design, U.S. Pat. No. 5,465,775 to Biba et al. (1995) disclosed an endless cord operating loop having lift cords connected to the endless loop. Although these concepts position a cord within an elongated wand, such concepts require numerous operating parts, are expensive to manufacture, and are not applicable to vertical blinds.

Accordingly, a need exists for a improved vertical blind system that encloses a cord for operating the blind. The system should be easy to manufacture and to operate.

SUMMARY OF THE INVENTION

The present invention provides an improved apparatus for moving vertical blind vanes relative to an opening such as a window or door opening. The invention comprises a cord operable to selectively transport the vanes horizontally across the opening. The cord has first and second cord lengths engaged in a looped end. A rotatable mechanism pivots each vane, and includes an opening for permitting passage of the first and second cord lengths. A bar retains the cord loop end at a fixed vertical position relative to the rotatable mechanism, and a cord lock selectively engages the first or second cord lengths. A handle attached to the cord lock is moveable relative to the rotatable mechanism for pulling one of the first or second cord lengths to move the vanes horizontally across the opening.

In an alternative embodiment of the invention, a header supports the vanes, a cylindrical mechanism has an aperture for permitting passage therethrough of the first and second cord lengths, and a bar has a first end which is fixed relative to the header and a second end for retaining the cord loop end at a fixed vertical position relative to the header. A handle is reciprocal relative to the cylindrical mechanism and is attached to the cord lock for selectively pulling the first or second cord lengths.

DESCRIPTION OF THE PREFERRED EMBODIMENTS

Figure 1:
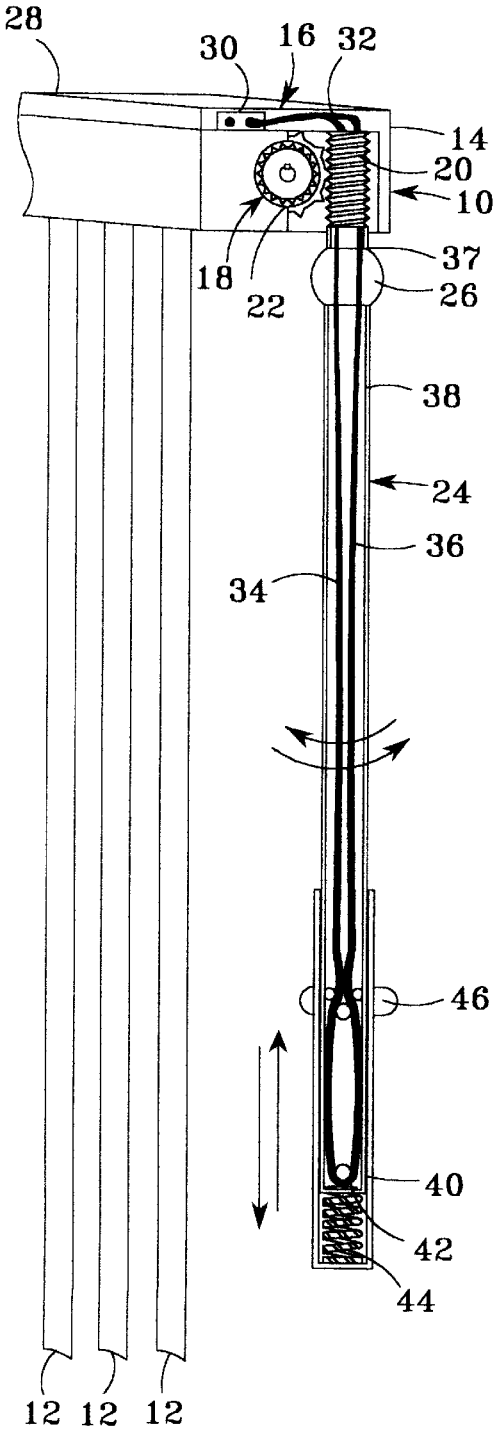
FIG. 1 illustrates a sectional elevation view of the present invention at an original position.

The present invention describes an improved window blind which eliminates the potential hazard caused an exposed looped cord. As used herein, the term "cord" means a string, chain, rope, wire, or other flexible line for operating a mechanism. Referring to FIG. 1, blind 10 is generally formed with louvers or vanes 12, head rail 14, and control mechanism 16. Vanes 12 are illustrated in a vertical position, but can be configured in a horizontal position in other embodiments of the invention described below. Blind 10 is positioned adjacent to a window or door opening (not shown) for the purpose of blocking the transmission of light or air therethrough. Head rail 14 is typically attached at the top of the opening so that vanes 12 are suspended by below head rail 14.

Vane rotating mechanism 18 is attached to head rail 14 and comprises helical worm gear 20 and drive gear 22. Worm gear 20 is engaged with handle 24 through articulated joint 26. Rotation of handle 24 about its longitudinal axis simultaneously rotates pinion gear 20 and engaged drive gear 22. Drive gear 22 is engaged with vane carrier 28 for rotation of each vane 12 about the longitudinal axis of each vane 12. Such rotation controls the plurality of vanes 12 to open and to close blind 10.

Closure mechanism 30 is operable to transport vanes 12 across the opening so that vanes 12 are positioned across the opening. As shown in FIG. 1, closure mechanism 30 is operable to move vanes 10 horizontally along head rail 14. Closure mechanism 30 is operated by controlling looped cord 32 having opening length 34 and closing length 36. When opening length 34 is pulled downward, closure mechanism 30 moves vanes 12 toward one side of the opening. When closing length 36 is pulled, closure mechanism 30 moves vanes 12 across the opening so that rotation of vanes 12 closes blind 10.

In a conventional window blind, a cord such as looped cord 32 hangs freely from the head rail and can pose a safety hazard. As shown in FIG. 1, the present invention eliminates this problem by enclosing cord 32 within handle 24. Consequently, the looped end of cord 32 is enclosed and is not exposed to persons proximate to blind 10. In a preferred embodiment of the invention, cord 32 passes through aperture 37 in worm gear 20. This configuration permits the rotation of worm gear 20 independent of cord 32, and further permits the movement of cord 32 independent of worm gear 20.

Figure 2:
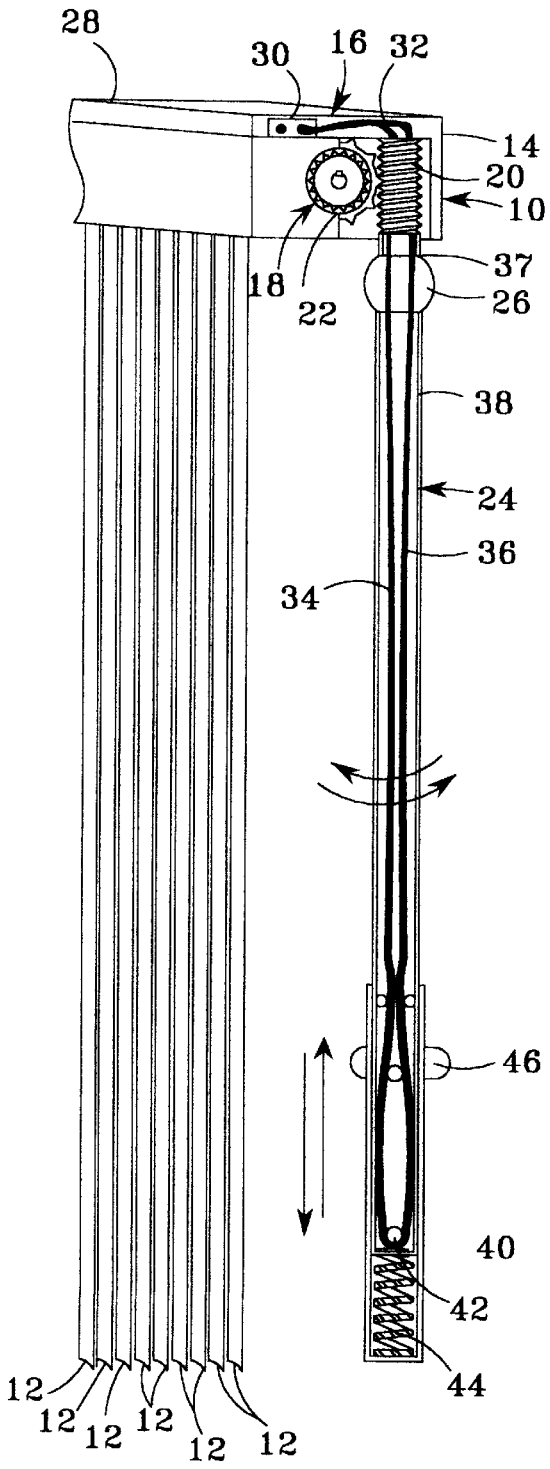
FIG. 2 illustrates a sectional view of the invention after the handle has been operated to move vanes in a window blind.

As shown in FIG. 1, handle 24 is shown as an upper housing 38 and lower housing 40. Cord 32 is looped around pivot 42. Lower housing 40 starts at an original position shown in FIG. 1 and can be pulled downwardly, as shown in FIG. 2, to selectively pull cord 32 to operate closure mechanism 30. Spring 44 connects lower housing 40 to upper housing 38 and returns lower housing 40 to the original position after the pulling force on lower housing 40 has been released. Controller or clasp 46 is engaged with lower housing 40 and selectively grasps opening length 34 or closing length 36.

Figure 3:
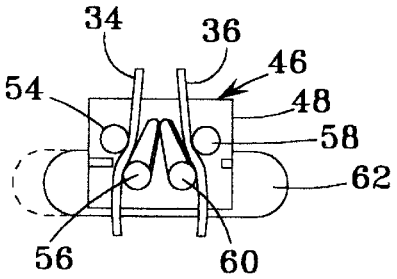
FIG. 3 illustrates a sectional elevation view of a controller for selectively engaging the cord.
Figure 4:
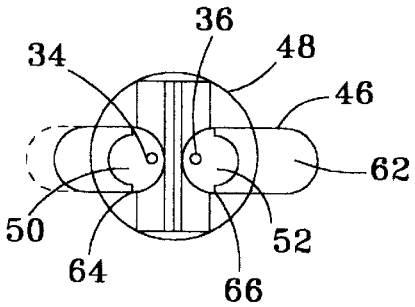
FIG. 4 illustrates a sectional plan view of the controller.

Refering to FIGS. 3 and 4, one embodiment of clasp 46 is illustrated. Clasp 46 includes body 48 having left chamber 50 and right chamber 52. Left chamber 50 has stationary roller 54 and traveling roller 56. Right chamber 52 has stationary roller 58 and traveling roller 60. Opening length 34 of cord 32 passes adjacent stationary roller 54 and traveling roller 56, and closing length 36 passes adjacent stationary roller 58 and traveling roller 60. The space between the stationary rollers and the traveling rollers should be sufficient to permit the free passage of cord 32 therebetween, but is sufficiently small in a preferred embodiment of the invention to create a slight amount of friction between such rollers and cord 32.

Figure 5:
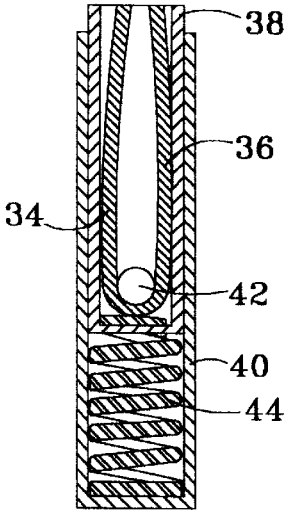
FIG. 5 illustrates a partial sectional view of a spring mechanism for returning the lower housing to the handle.

Switch 62 passes through left chamber 50 and right chamber 52 and extends on either side of clasp 46. As shown in the embodiment of FIG. 1, switch 62 includes left fork 64 and right fork 66. When switch 62 is moved to the right as shown in FIG. 3, left fork 64 interferes with left traveling roller 56. When lower housing 40 and attached clasp 46 are moved downwardly relative to handle 24, right traveling roller 60 moves upwardly relative to clasp 46 and grasps closing length 36 of cord 32 against right stationary roller 58. This operation pulls closing length 36 of cord 32 downwardly and closes vanes 12 across the opening. When the downward force on lower housing 40 is removed, spring 44, with detail shown in FIG. 5, returns lower housing 44 to the original position shown in FIG. 1.

To open blind 10, switch 62 is moved to the left, right fork interferes with right traveling roller 60, and a downward pull on lower housing 40 causes left traveling roller to grasp opening length 34 of cord 32 against left stationary roller 54. Continued downward movement of lower housing 40 pulls opening length 34 to withdraw vanes 12 from across the opening so that blind 10 is opened.

In the embodiment of the invention described above, upper housing 38 and lower housing 40 are operated independently to accomplish the desired functions. Upper housing 38 can be rotated to rotate vanes 12, and lower housing 40 can be operated to move vanes 12 across the opening. The unique combination of these features permits the rotation of upper housing 38 without twisting cord 32 enclosed therein.

Although clasp 46 is depicted in the Figures as a mechanical switching device, many different constructions and embodiments of a clasp can be constructed within the scope of the invention. Clasp 46 performs the function of selectively permitting engagement with opening length 34 or closing length 36 of looped cord 32. This function can be accomplished by different designs and constructions.

Figure 6:
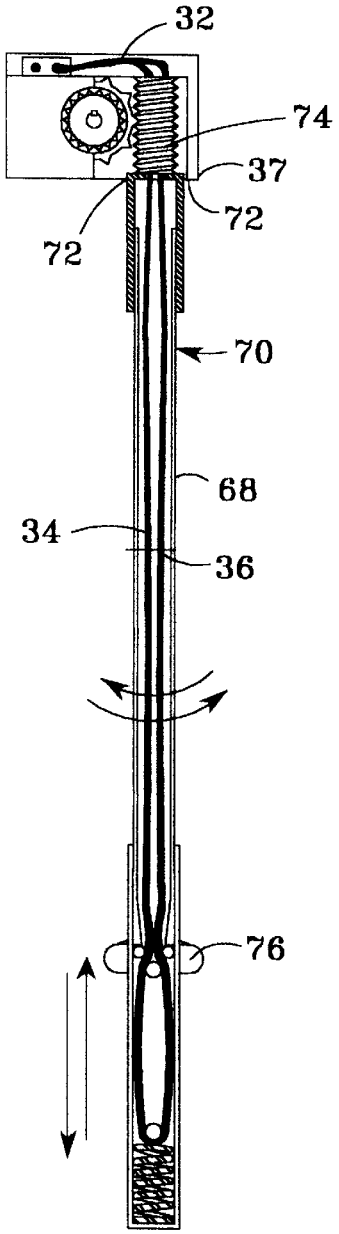
FIG. 6 illustrates an alternative embodiment of the invention.

Lower housing 40 is shown as being smaller than upper housing 38, and as being attached thereto with spring 44. It will be appreciated that many different configurations of upper housing 38 and lower housing 40 can be made within the scope of the invention. For example, lower housing 40 could have a larger diameter than upper housing 38. As shown in FIG. 6, lower housing 68 could substantially comprise the entire length of handle 70. In one variation of this embodiment, lower housing 68 could include prongs 72 engagable with control mechanism 74. When prongs 72 are engaged with control mechanism 74, rotation of lower housing 68 similarly rotates control mechanism 74 to rotate vanes 12. Lower housing 68 can be pulled downwardly to selectively manipulate cord 32 as described above. As shown in FIG. 6, clasp 76 can be connected to lower housing 68 at the bottom end of lower housing 68 to facilitate access to clasp 76.

Figure 7:
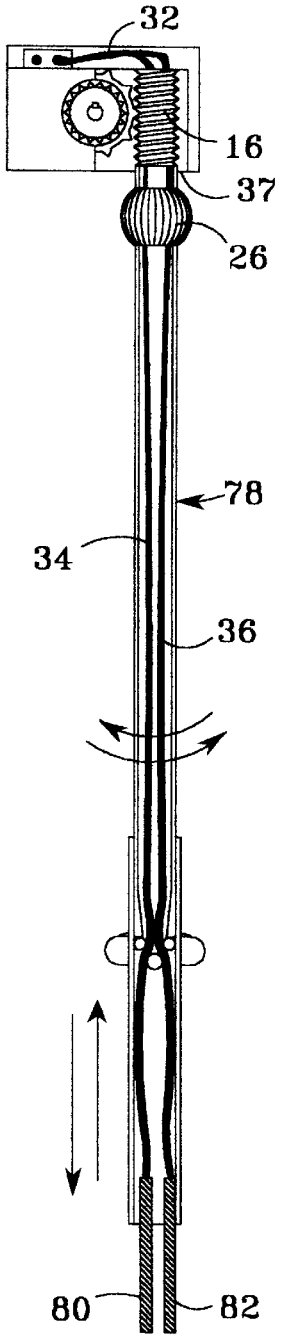
FIG. 7 illustrates an alternative embodiment of the invention.

In another embodiment of the invention shown in FIG. 7, handle 78 can be engaged with control mechanism 16 as shown in FIGS. 1 and 2, and the loop of cord 32 can be severed to free the ends of opening cord length 34 and closing cord length 36. Left wand 80 is attached to opening cord length 34, and right wand 82 is attached to closing cord length 36. Left wand 80 can be pulled downwardly to move vanes 12 to open blind 10, and right wand 82 can be pulled downwardly to move vanes 12 to close blind 10. The upper ends of left wand 80 and right wand 82 are enclosed within handle 78 so that cord length 34 and cord length 36 are never exposed when wands 80 and 82 are operated. As described before, cord lengths 34 and 36 are preferable inserted through aperture 37 in gear 20.

Figure 8:
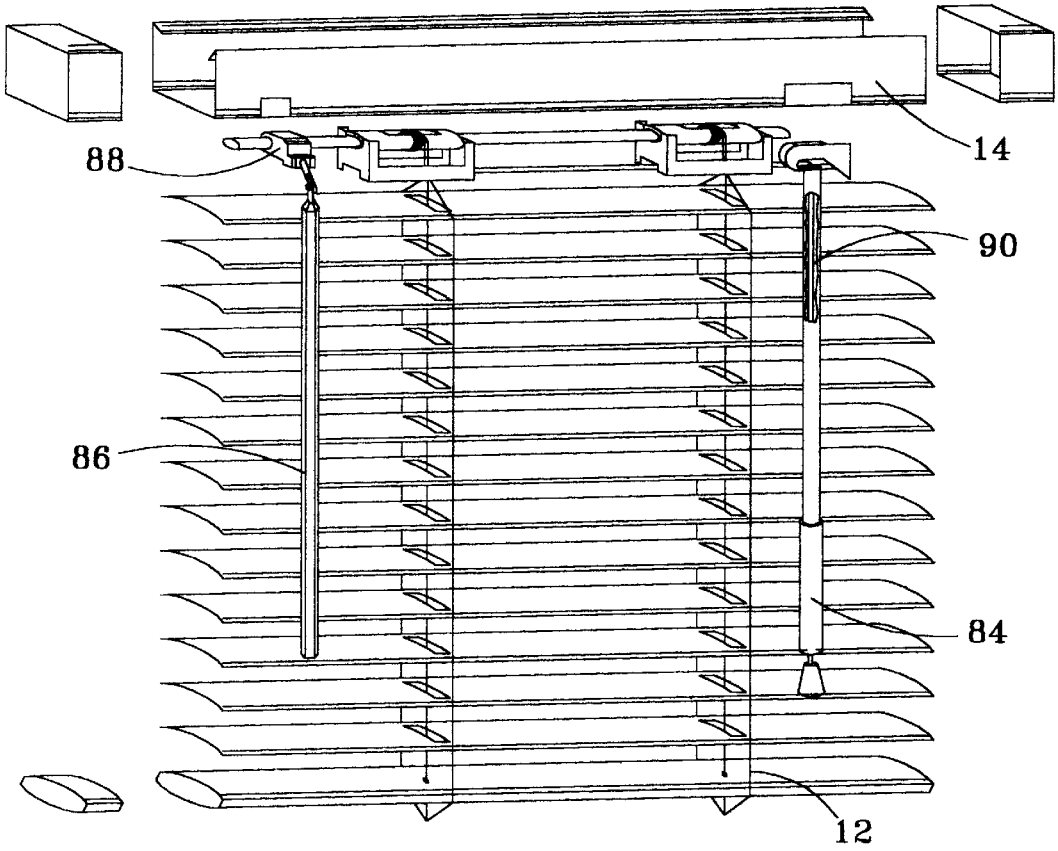
FIG. 8 illustrates a blind having horizontal vanes.

Although the present invention is illustrated in operation with vertical vanes 12, the invention is equally operable with horizontal vanes. As shown in FIG. 8, the operation of cord 84 would move vanes 12 upwardly and downwardly relative to head rail 14. Wand 86 is engaged to rotating mechanism 88 and can be turned to rotatably open and close vanes 12. Cord 84, enclosed within handle 90, can be pulled to raise and lower vanes 12. In an alternative embodiment of the invention, cord 84 could be connected to vane rotating mechanism 88 so that operation of cord length 84 would rotate vanes 12 to open the blind, and operation of cord length wand 86 would rotate vanes 12 to close the blind. The reversability of these functions is easily accomplished by the present invention because handle 90 functions independently of wand 86.

Figure 9:
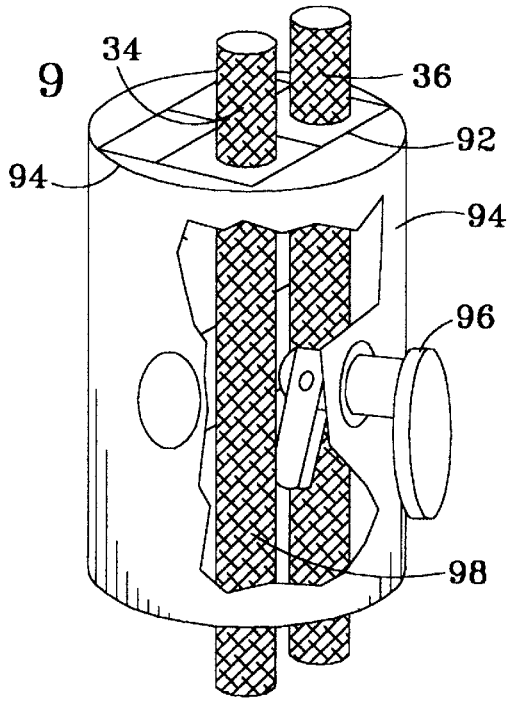
FIG. 9 illustrates an alternative clasp selectively grasping one end of the looped cord.

As shown in FIG. 9, an alternative embodiment of a clasp mechanism is shown. As shown in FIG. 9, clasp housing 92 is enclosed with handle 94 and has lever 96 protruding through channel 98 of handle 94. Lever 96 can be moved transversely within clasp housing 92 to selectively grasp opening length 34 or closing length 36 of looped cord 32.

Figure 10:
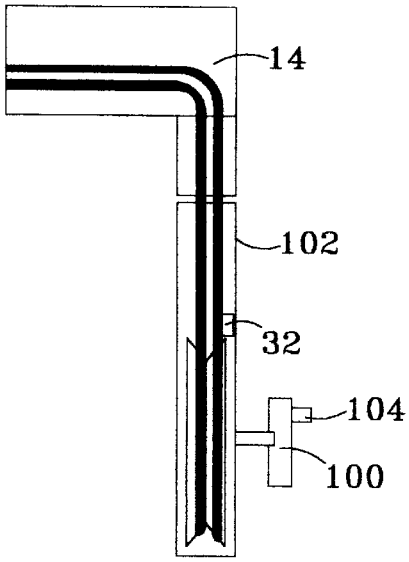
FIG. 10 illustrates a take-up spool attached to a handle for capturing excess length of the looped cord.

In another embodiment of the invention, a spool or takeup reel can be positioned to capture looped cord 32. As shown in FIG. 10, spool 100 is positioned at the lower end of handle 102, and captures any portion of looped cord 32 extending below handle 102. Handle 104 can be attached to spool 100 to facilitate the operation of spool 100. In one variation of this embodiment, spool can be rotated one direction to open vanes 12 and can be rotated in the opposite direction to close vanes 12.

Figure 11:
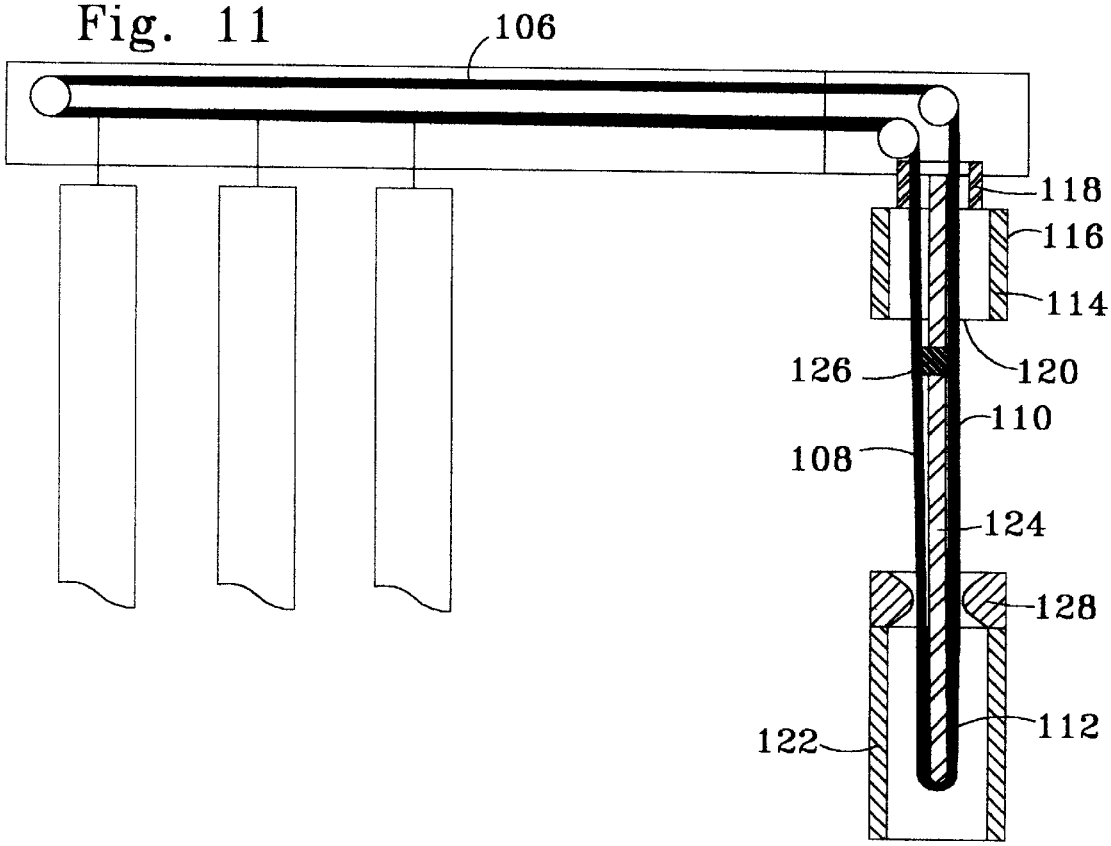
FIG. 11 illustrates one embodiment of the invention showing a handle which is moveable relative to a rotatable mechanism.

FIG. 11 illustrates another embodiment of the invention wherein cord 106 has first cord length 108 and second cord length 110 terminating in cord looped end 112. Rotatable mechanism 114 includes grip 116 and gearbox 118 and has an opening 120 to permit the passage therethrough of first cord length 108 and second cord length 110. Rotation of mechanism 114 cooperates with gearbox 118 to pivot each vane about an axis parallel to the opening as previously described. Handle 122 is placed below rotatable mechanism 114 for the purpose described below. Bar 124 has an upper end vertically fixed relative to rotatable mechanism 114, and retains cord looped end 112 at a fixed vertical position relative to rotatable mechanism 114. Stop 126 is attached to bar 124, or can be integrated into bar 124 for the purpose described below. Bar 124 can comprise a square member, or can be triangular, cylindrical, oval, circular, or other configuration. Stop 126 can comprise a simple pin or can comprise a switching mechanism as described below.

Cord lock 128 is attached to handle 122 for gripping or otherwise engaging cord 106 and is moveable with handle 122 relative to rotatable mechanism 114. When cord lock 128 grasps first cord length 108, downward movement of handle 122 and cord lock 128 pulls first cord length 108 to move the vanes horizontally relative to the opening.

As first cord length 108 is pulled by downward movement of handle 122 and cord lock 128, cord 106 moves the vanes away from the opening so that the blind is opened and the opening is unobstructed. Cord lock 128 can be operated to release first cord length 108, handle 122 can be moved upwardly, cord lock 128 can reengage first cord length 108, and handle 122 can be moved downwardly to continue movement of cord 106 to open the blind.

To reverse the direction of cord 106 movement, handle 122 can be moved upwardly so that cord lock 128 contacts stop 126, thereby causing cord lock 128 to release first cord length 108 and to engage second cord length 110. In this fashion, cord lock 128 and stop 126 cooperate to form a switch which alternately causes cord lock 126 to grip first cord length 108 or second cord length 110. Subsequent downward movement of handle 122 pulls second cord length 110 and moves the vanes horizontally across the opening, in the opposite direction of the previous movement, to close the blind over the opening. Cord lock 128 can subsequently contact stop 126 to release second cord length 110, to engage first cord length 108, and to repeat the cycle.

Although cord lock 128 is shown as a pressure sensitive switch that can be operated by contact with stop 126, cord lock 128 can be configured as a switch shown in other Figures herein, or can be constructed in other configurations. Cord lock 128 performs the function of selectively grasping first cord length 108 or second cord length 110, within interfering with the operation of cylindrical mechanism 136.

Figure 12:
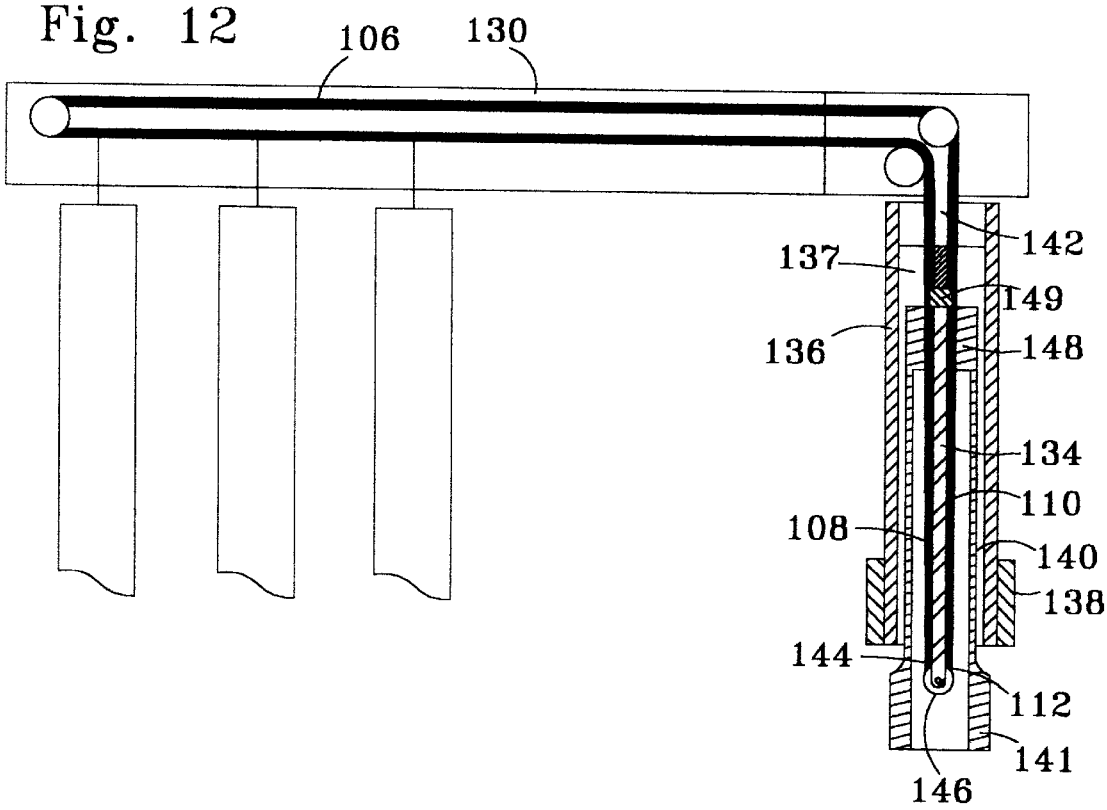
FIG. 12 illustrates one embodiment of the invention wherein a handle is reciprocal relative to a cylindrical mechanism, and wherein first and second cord lengths are enclosed by the handle and cylindrical mechanism.

Another embodiment of the invention is illustrated in FIG. 12, wherein header 130 supports the vanes in a position proximate to the opening. Cord 106 is partially contained within header 130, and cord loop end 112 hangs vertically below header 130. Cord loop end 112 is engaged with pulley 132, which is attached to the lower end of bar 134. Cylindrical mechanism 136 provides a function similar to that of rotatable mechanism 114, and is generally shaped as a cylinder having a hollow center or an aperture 137 therethrough for permitting the passage of first cord length 108 and second cord length 110. Grip surface 138 can be attached to cylindrical mechanism 136. Handle 140 is shown as a cylinder reciprocally insertable within the hollow center of cylindrical mechanism 136 in a preferred embodiment of the invention. Handle 140 can include grip 141 attached to the lower end of handle 140 for facilitating a person's ability to operate handle 140, and for limiting the travel of handle 140 within the hollow center of cylindrical mechanism 136.

Bar 134 is illustrated as a member having an upper or first end 142 and a lower second end 144. First end 142 is attached to header 130, and second end 144 freely hangs downwardly and is attached to pulley 146. Cord lock 148 can be attached to handle 140 and is configured to alternately grip first cord length 108 or second cord length 110 as previously described. As shown in FIG. 12, cord lock 148 grips first cord length 108. As handle 140 is pulled downwardly, the portion of cord 106 in contact with pulley 146 moves relative to pulley 146, and first cord length 108 is pulled downwardly relative to header 130. In this fashion, first cord length 108 moves the vanes horizontally across the opening to open the blind so that the vanes do not obstruct the opening. Cord lock 148 can release first cord length 108 so that handle 140 is raised, and cord lock 148 can reengage first cord length 108 so that lowering of handle 140 moves first cord length 108 in the same direction.

Handle 140 can be raised so that stop 149 contacts cord lock 148. Stop 149 can comprise a part of bar 134 or can comprise a distinct switching mechanism for cooperating with cord lock 148 asx previously described. Engagement between stop 149 and cord lock 148 operates cord lock 148 to release first cord length 108 and to grip second cord length 110. Subsequently, handle 140 can be moved downwardly to pull second cord length 110, thereby moving the vanes across the opening, in a direction opposite to the previous direction of travel, to close the blind. This process can be repeated by contacting cord lock 148 against stop 149 so that cord lock 148 releases second cord length 110 and grips first cord length 108.

It will be appreciated that numerous cord lock configurations can be constructed without departing from the inventive concepts expressed herein. For example, cord lock 148 can be configured to function in different ways. In one embodiment of the invention, the cord lock can be released and reengaged with first cord length 108 and second cord length 110 by rotating cord lock 148. Such rotation can be performed with axial reciprocal movement of bar 140, or by axially rotating bar 134 relative to handle 140. In another embodiment of the invention, the cord lock can be configured to be manually operated with a simple toggle switch. Although the combination of a handle, bar, and cord lock can have many different configurations within the scope of the invention, such components cooperate to selectively and alternatively manipulate first cord length 108 and second cord length 110 to move the vanes.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for moving vertical blind vanes relative to an opening, comprising:

a cord operable to selectively transport the vanes horizontally across the opening, wherein said cord includes first and second cord lengths engaged in a looped end;

a rotatable mechanism for pivoting each vane about a vane axis parallel to the opening, wherein said rotatable mechanism includes an opening for permitting passage therethrough of said first and second cord lengths;

a bar having a lower end for retaining said cord looped end at a fixed vertical position relative to said rotatable mechanism;

a cord lock for selectively engaging said first cord length or said second cord length; and a handle attached to said cord lock, wherein said handle is vertically moveable relative to said rotatable mechanism, when said cord lock is engaged to pull one of said first or second cord lengths, to move the vanes horizontally across the opening; wherein the outside surface of said handle is cylindrical, and wherein said handle is insertable within the hollow center of said rotatable mechanism.

2. An apparatus as recited in claim 1, wherein said cord lock engages said first cord length so that downward vertical movement of said handle draws the vanes to open the vertical blind.

3. An apparatus as recited in claim 1, wherein said cord lock engages said second cord length so that downward vertical movement of said handle draws the vanes to close the vertical blind.

4. An apparatus as recited in claim 1, wherein said handle and rotatable mechanism substantially enclose the first and second cord lengths of said cord.

5. An apparatus as recited in claim 1, wherein said rotatable mechanism comprises a cylinder having a hollow center.

6. An apparatus as recited in claim 1, further comprising a pulley attached to the lower end of said bar for engaging the looped end of said cord.

7. An apparatus as recited in claim 6, wherein said handle and said rotatable mechanism substantially enclose said bar and the first and second cord lengths of said cord.

8. An apparatus as recited in claim 7, wherein said cord lock is responsive to contact with said bar to selectively engage said first cord length, and wherein said cord lock is responsive to contact said bar to disengage said first cord length and to engage said second cord length.

9. An apparatus for moving vertical blind vanes relative to an opening, comprising:

a header for supporting the vanes;

a cord having first and second cord lengths engaged in a looped end, wherein said cord is engaged with said header for selectively transporting the vanes relative to the opening;

a cylindrical mechanism engaged to rotatable pivot each vane about a vane axis parallel to the opening, wherein said cylindrical mechanism includes an aperture for permitting passage therethrough of said first and second cord lengths;

a bar having a first end fixed relative to said header, and having a second end distal from said first end for retaining said cord looped end at a fixed vertical position relative to said header;

a cord lock operable to selectively engage said first cord length or said second cord length; and a handle attached to said cord lock, wherein said handle is reciprocal relative to said cylindrical mechanism, and wherein said handle is engaged with said cord lock so that movement of said handle and cord lock operates one said first or second cord lengths to move the vanes relative to the opening; and stop attached proximate to the fixed end of said bar, and wherein upward movement of said handle contacts said cord lock against said stop to cause said cord lock to release said first or second cord length and to engage the other cord length.

10. An apparatus as recited in claim 9, wherein said handle and said cylindrical mechanism substantially enclose the first and second cord lengths of said cord.

11. An apparatus as recited in claim 9, wherein said cylindrical mechanism has a hollow center, and wherein said handle is reciprocal within the hollow center of said cylindrical mechanism.

12. An apparatus as recited in claim 9, wherein said handle substantially comprises a hollow cylinder, and wherein said bar is positioned within said hollow cylinder.

13. An apparatus as recited in claim 9, further comprising a cord pulley attached to said bar for engagement with the looped end of said cord.

* * * * *